US005996143A

United States Patent [19]

Lordahl et al.

[11] Patent Number: 5,996,143

[45] Date of Patent: Dec. 7, 1999

[54] POP UP LAVATORY PLUG

[76] Inventors: Var E. Lordahl, 1571 Shaefer Rd., Long Grove, Ill. 60047; Alex Riutis, 537 Commanche Trail, Wheeling, Ill. 60090

[21] Appl. No.: 09/036,469

[22] Filed: Mar. 6, 1998

[51] Int. Cl.[6] ..... E03C 1/232

[52] U.S. Cl. ..... 4/689; 4/691; 4/688

[58] Field of Search ..... 4/689, 691, 692, 4/623, 688, 684, 685, 690, 679

[56] References Cited

U.S. PATENT DOCUMENTS 1,597,459 8/1926 Muend ..... 4/691
5,050,247 9/1991 Hsu ..... 4/688
5,363,518 11/1994 Mowery ..... 4/692
5,363,519 11/1994 Husting ..... 4/689

*Primary Examiner*—David J. Walczak
*Attorney, Agent, or Firm*—Kajane McManus

[57] ABSTRACT

The pop up lavatory plug comprises a body which depends from a head and has a trailing connector. The connector is elongate and has a linear array of bores therein. The head has a cavity in a top surface thereof which engages an overcap. Extending downwardly into the plug body from within the cavity is a slot by means of which an overcap assembly can be floatingly engaged to the plug in place of the overcap when it is desired to cover a visible flange of a drain assembly rather than merely selectively sealing an orifice of the drain assembly as is accomplished when the overcap is used.

21 Claims, 4 Drawing Sheets

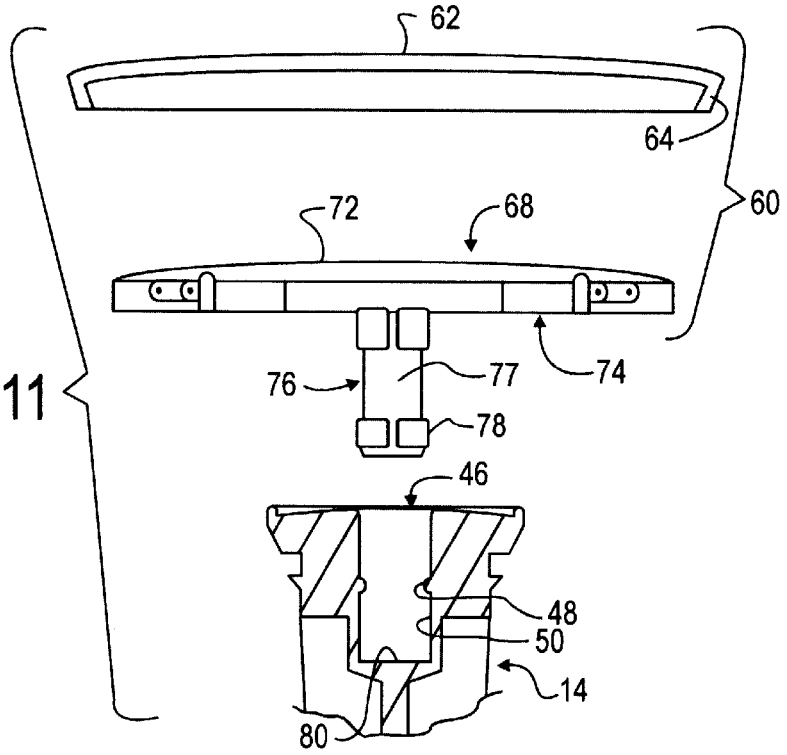
FIG. 11
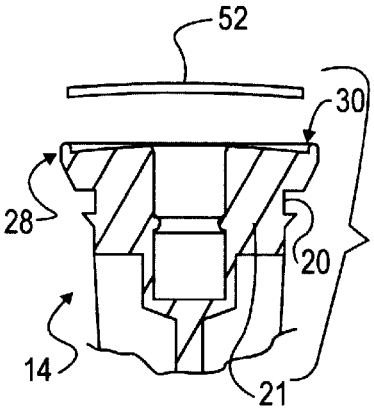
FIG. 10
FIG. 12
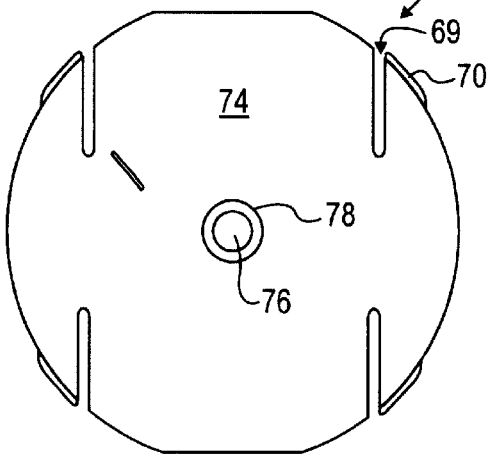

POP UP LAVATORY PLUG

BACKGROUND OF THE INVENTION

The present invention relates to a removable center plug of a lavatory pop up drain assembly, commonly referred to as a "Pop-Up Plug". Specifically, the plugs of the present invention outwardly appear to be and function in a manner equivalent to OEM factory models but are convertible to special decorator models merely by use of an accessory overcap, the overcap assembly floats up and down relative to a body of the plug so as not to interfere with original seal designs. This feature accommodates all OEM models, old and new, without risk of leakage. The plugs, when converted, cover the entire OD of a flange of a pop up drain assembly in the lavatory thereby eliminating the need to change the entire assembly if the flange is damaged, discolored or if it is desired to change aesthetics, for example, from chrome to polished brass.

PRIOR ART

Heretofore, faucet manufacturers have made their own pop-up drain assemblies sold primarily in conjunction with the sale of their faucets, i.e., if a lavatory faucet is purchased, a pop up drain assembly is included.

Each pop-up drain assembly, has a removable center plug which once removed leaves a visible female flange with depending drain sleeve assembly in the bottom of the lavatory (sink).

Due to discoloration, tarnish, breakage, damage, theft, misplacement or loss, such center plugs need to be replaced from time to time. Historically, drain assemblies of one manufacturer have not been interchangeable with those of a competitor.

The designs of these plugs may vary in width, head size, length and specific seal surface configuration. Everything must fit perfectly or the plug will not seal or might jam during operation. This has led to the need for a consumer to purchase an exact replacement plug.

Additionally, when a new plug is inserted into an old assembly, it often makes the old flange of the drain assembly displeasing in appearance. Such disparity in appearance has often necessitated replacement of the entire drain assembly.

To overcome the need to replace an entire assembly, a pop up plug incorporating an oversized head which covers the flange has also been proposed. Such plug, again, is manufacturer specific and accommodates the sealing of the drain assembly by being specifically configured.

In the above cases, it becomes imperative to identify the manufacturer and particular embodiment of the drain assembly. This is often impossible to ascertain and, even if discernable, it is often found that the particular embodiments are no longer being produced, making the task of finding an appropriate replacement plug an onerous burden on the consumer.

SUMMARY OF THE INVENTION

Accordingly, it is a primary object of the present invention to provide a pop up lavatory plug which is functionally engageable within many of a plurality of drain assembly embodiments and which will sealingly seat upon a radial flange of the assembly without allowing seepage of water therepast.

This object, as well as others, is met by the pop up lavatory plug of the present invention which comprises an elongate body or stem including an elongate trailing connector having a plurality of vertically aligned throughbores therein for engaging an actuator at a level appropriate to allow sealing engagement between a head of the plug and a radial flange of the drain assembly, and further includes structure providing a head which may incorporate an overcap assembly which can float, relative to the body, to assure the sealing engagement, using gravity as a prime mover for the floating head.

BRIEF DESCRIPTION OF THE DRAWINGS

FIG. 10 is a cross sectional view through the plug head of FIG. 9 showing a cap plate which engages within the cavity therefor.

FIG. 11 is a cross sectional view through the head of the plug and an overcap assembly to be floatingly engaged thereto.

FIG. 12 is a bottom plan view of a cap plate of the overcap assembly of FIG. 11.

DESCRIPTION OF THE PREFERRED EMBODIMENTS

Figure 1:
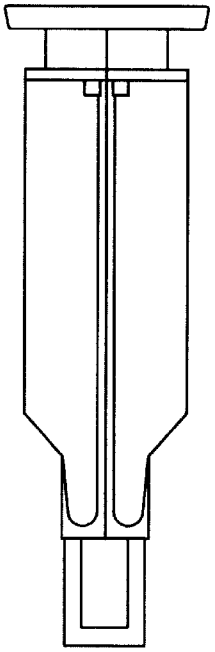
FIG. 1 PRIOR ART
FIGS. 1–5 illustrate various embodiments of present day pop up lavatory plugs.
Figure 2:
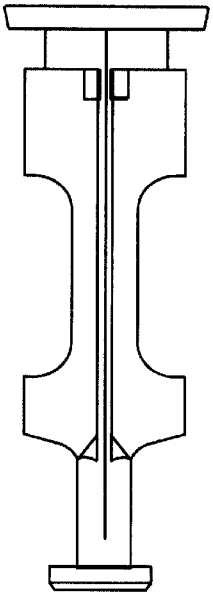
FIG. 2 PRIOR ART
Figure 4:
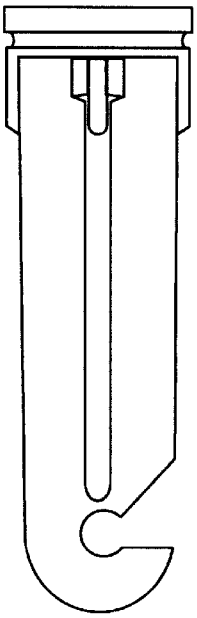
FIG. 4 PRIOR ART
Figure 3:
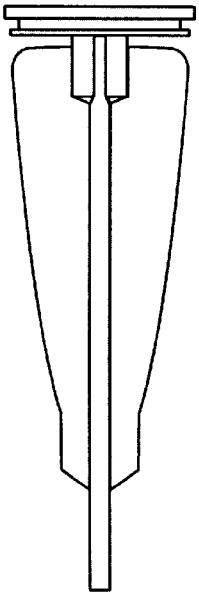
FIG. 3 PRIOR ART
Figure 5:
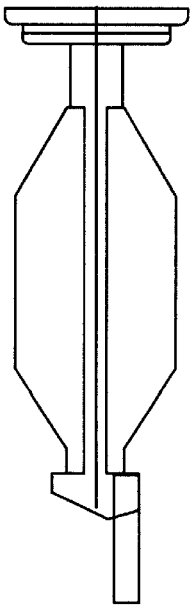
FIG. 5 PRIOR ART

Referring now to the drawings in greater detail there is illustrated in FIGS. 1–5 a plurality of present day embodiments of a lavatory pop up plug as produced by various manufacturers. It will be seen that the configurations vary significantly one from the other and such variance makes replacement with a plug having an appropriate functional configuration a significant task. The difficulty of the task is further increased when the manufacturer is unknown, many times necessitating replacement of an entire drain assembly rather than mere replacement of the plug.

Figure 6:
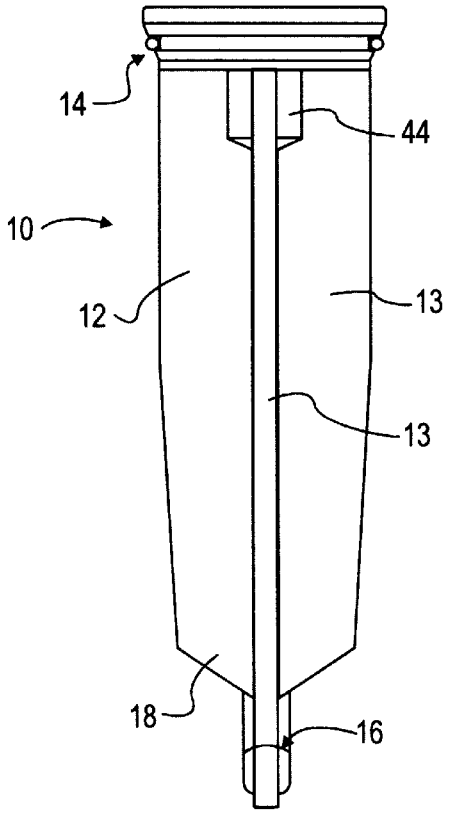
FIG. 6 is a side view of a pop up plug made in accordance with the teachings of the present invention.

Turning now to FIG. 6, there is illustrated therein the generic pop up lavatory plug made in accordance with the teachings of the present invention and generally identified by the reference numeral 10.

As illustrated, in its most generic form, the plug 10 comprises an elongate body 12 comprised of guide splines 13 which depend from a head 14 and includes a trailing connector 16 at a lower end 18 thereof.

The head 14 includes a circumferential groove 20 about a base 21 thereof within which a suitable seal member 22, such as an O ring 24 or a feather gasket 26 (FIG. 8) is releasably engaged. Above the groove 20, the head 14 includes a chamfered periphery ring portion 28 which will be described further hereinafter.

Figure 7:
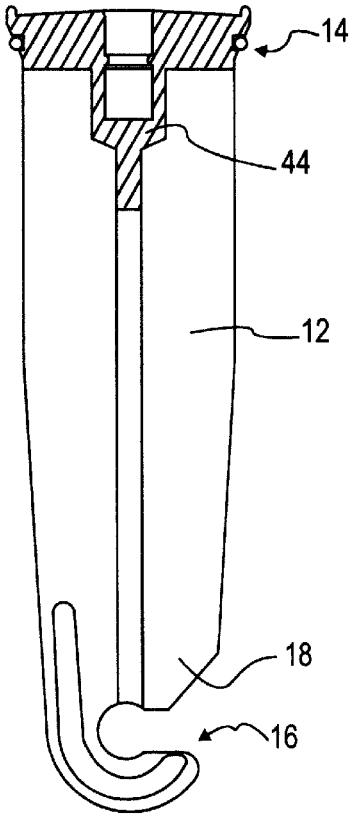
FIG. 7 is a cross sectional view through the pop up plug of FIG. 6.
Figure 8:
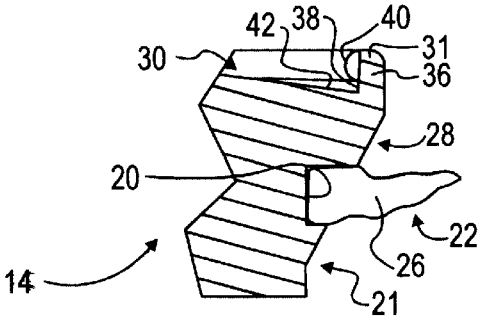
FIG. 8 is an enlarged cross sectional view of a portion of a plug head showing a cap plate receiving cavity with circumferential retaining rib thereof.

The ring portion 28 of head 14, as seen in FIG. 7, also includes a shallow cavity 30 in a top surface 31 thereof which has a circular periphery and is radially outwardly and downwardly arced from a center point 32 of the top surface 31 of the ring portion 28, producing a peripheral vertical flange 36 around the ring portion 28. As best illustrated in FIG. 8, the flange 36 includes an inner wall 38 which includes an annular rib 40 thereon which is vertically spaced from a bottom peripheral edge 42 of the cavity 30.

Figure 9:
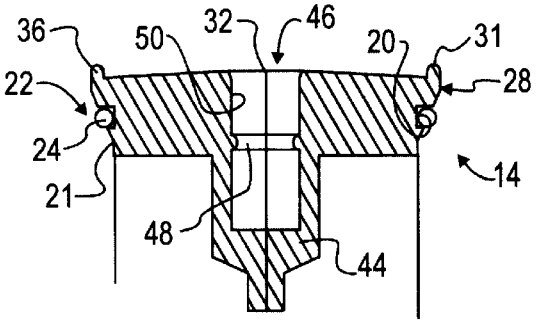
FIG. 9 is an enlarged cross sectional view of the plug head detailing a centered vertical slot therein, extending downwardly from the cap plate receiving cavity into a collar of the plug.

The head 14 also includes a narrow collar 44 which depends therefrom in a centered manner into the body 12. Extending downwardly from the cavity 30 in the head 14 into the collar 44 is a centered cylindrical bore 46 which is hourglass shaped, including a circumferential retaining rib 48 on a sidewall 50 thereof, approximately centered along a length of the bore 46. These structures are best illustrated in the enlarged view of the head 14 of FIG. 9.

Turning now to FIG. 10, a cross section of the plug head 14 is shown in combination with a overcap 52 which is configured to mimic the arcuate configuration of the cavity 30 and engages therewithin by snap fitting into entrapment beneath the rib 48. The overcap 52 is created to appear metallic, in one of the commonly used finishes for a drain assembly (FIG. 15) and at least the ring portion 28 of the head 14 will also appear to be of a metallic finish corresponding to that of the overcap 52.

Thus, when the overcap 52 is snapped into place, the aesthetics of at least the ring portion 28 of the plug head 14 should correspond to those visible of the drain assembly, eliminating the need for replacement thereof in its entirety.

Should an aesthetically pleasing match not be producible or should sealing of a drain not be well afforded, due to head size or configuration mismatch, an overcap assembly 60 such as that shown in combination with the head 14 in FIG. 11 is proposed for use.

The overcap assembly 60 comprises a metallic appearing overcap 62 which has an inwardly crimped depending circumferential edge 64. This overcap 62 engages upon a support plate 68 which is of a firm material but is capable of limited flexing due to the provision of a plurality of full thickness edge slits 69 therein. Adjacent each slit 69 is a small tab 70 which flexes into an interior of the overcap 62, extending past the crimped edge 64 to engage the overcap 62 onto and over a top surface 72 of the support plate 68.

Extending outwardly from a bottom surface 74 of the support plate 68 is a pin 76 having a stalk 77 and a radially enlarged tip 78.

The pin 76 is centrally located on the support plate 68 and has a length approximately equal to the length of the centered bore 46 in the head 14. The stalk 77 of the pin 76 has a diameter which is smaller than an inner diameter of the circumferential retaining rib 48 of the bore 46, so that the pin 76 can slide within the bore 46 until the tip 78 of the pin 76 engages the rib 48.

During insertion of the pin 76 into the bore 46, pressure is applied against the support plate 68 until the tip 78 of the pin 76 is forced past the rib 48, securely engaging the overcap assembly 60 to the plug 10. Because the vertical extent of the enlarged tip 78 of the pin 76 is minimal, the pin 76 slides up and down within the bore 46 between positions where the tip 78 rests against a base 80 of the bore 46, at one extreme, and where the tip 78 engages against rib 48, at the other extreme. Thus, within these limits, the overcap assembly 60 can vertically "float" in position relative to the plug head 14.

Figure 15:
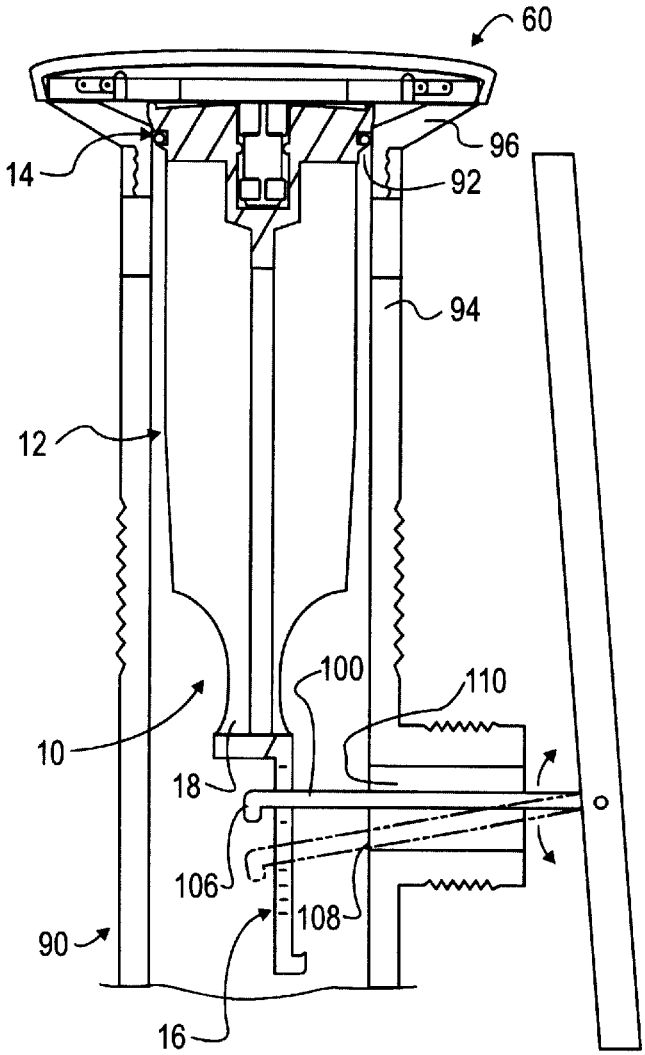
FIG. 15 is a cross sectional view of an upper portion of a drain assembly showing a cross sectional view of a plug including the overcap assembly of FIG. 11 functionally engaged within a sleeve of the drain assembly, in an orifice sealing position.

The desire for such self-adjusting relative positioning between the plug head 14 and the overcap assembly 60 will be best understood from perusal of FIG. 15.

It will first be seen that the overcap assembly 60 is of such radial extent that, when engaged within a drain assembly 90, it covers not only an orifice 92 leading to drain sleeve 94, but also covers a visible radial flange 96 of the drain assembly 90.

Because of the variations by manufacturer in flange 96 design, extent, angulation, etc., it will be appreciated that a disparity between positioning of the overcap assembly 60 and seal formation through appropriate positioning of the head 14 and its seal member 22 within the orifice 92 could arise, if there were no capability for relative positioning therebetween.

For instance, if the slope of the radial flange 96 were extreme, the plug head 14 would be suspended at an elevated position, which could not effectively seal the orifice 92. On the other hand, if the slope were minimal, the head 14 would seat appropriately but the overcap assembly 60 would remain elevated above the flange 96 rather than resting thereupon.

Accordingly, only by affording such relative positioning, can a truly generic pop up plug 10 be provided.

Figure 14:
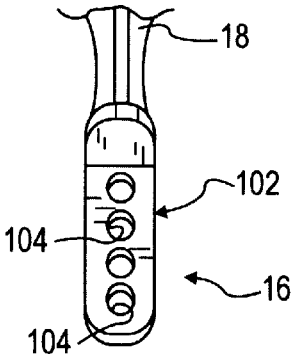
FIG. 14 is a perspective view of an elongated trailing connector which the plug of FIG. 6 may incorporate.

Incorporating a study of FIG. 14, it will be remembered that a pop up plug 10 includes a trailing connector 16 which must functionally engage a plug actuator rod 100 which is provided at a relative vertical position set by the manufacturer.

Figure 13:
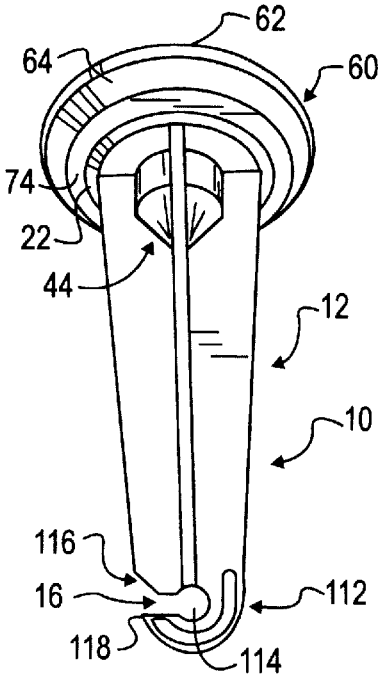
FIG. 13 is a perspective view of the plug of FIG. 6 with the overcap assembly of FIG. 11 engaged thereto.

Although it is feasible to create a plug 10 having a single point connector 16 as illustrated in FIG. 13 to comprise a depending flange 112 having a centered bore 114 therein to which a horizontally oriented radial slot 116 extends from a periphery 118 of the flange 112, to accommodate a greater number of position options for the actuator rod 100, the connector 16 shown in FIGS. 14 and 15 is proposed.

As illustrated, the connector 16 here comprises an elongate trailing shank 102 depending from the lower end 18 of the body 12. The shank 102 includes a vertical array of bores 104 therein for engaging a terminal end 106 of the actuator rod 100 as best shown in FIG. 15.

By provision of the vertical array of bores 104 along the length of the elongate shank 102, many variously positioned actuator rods 100 may be accommodated by a single plug 10 to provide a substantially horizontal orientation for the rod 100, without concern for potential lack of actuator rod 100 operability because of interference with rod 100 pivotability by obstruction against an edge 108 of an opening 110 in the sleeve 94, through which the actuator rod 100 must necessarily pass.

As described above, the pop up plug 10 of the present invention provides a number of advantages, some of which have been described above and others of which are inherent in the invention. Also, modifications nay be proposed to the plug 10 without departing from the teachings herein. Accordingly the scope of the invention is only to be limited as necessitated by the accompanying claims.

We claim:

1. A pop up lavatory plug comprising an elongate body consisting of guide splines configured to slidingly seat within a sleeve of a drain assembly, the body depending from a head configured to seat within and substantially seal an orifice of the drain assembly and further being configured to accommodate selective engagement of more than one embodiment of an overcap assembly comprising an overcap engaged over a support plate which is telescopic relative to the head of the plug, and the body including at a bottom end thereof a connector for operatively engaging a plug actuator extending into the sleeve.

2. The plug of claim 1 wherein said connector comprises a bore centered within a depending flange.

3. The plug of claim 2 wherein a horizontally oriented radial slot extends from a periphery of the flange into communication with said centered bore.

4. The plug of claim 1 wherein said connector comprises an elongate trailing shank having a vertical array of bores therein.

5. The plug of claim 1 wherein said head includes a circumferential groove extending about a base thereof.

6. The plug of claim 5 wherein a seal member is releasably engaged within said groove.

7. The plug of claim 5 wherein the head includes a chamfered periphery ring portion above the groove.

8. The plug of claim 7 wherein said ring portion has a top surface having a shallow cavity therein.

9. The plug of claim 8 wherein said shallow cavity is defined by a circular peripheral wall.

10. The plug of claim 9 wherein said wall includes an annular rib which is vertically spaced from a bottom peripheral edge of said cavity.

11. The plug of claim 10 including a circular overcap which is configured to engage within the shallow cavity.

12. The plug of claim 11 wherein said circular overcap is engageable beneath the annular rib in a snap fit manner and is held in place thereby.

13. The plug of claim 8 wherein a centered narrow collar extends into the body from the head.

14. The plug of claim 13 wherein a centered cylindrical bore extends into the collar from the cavity.

15. The plug of claim 14 wherein said bore has a circumferential retaining rib approximately vertically centered along a length thereof.

16. The plug of claim 15 wherein the support plate has a centered pin extending from a bottom surface thereof.

17. The plug of claim 16 wherein said pin comprises a stalk having a radially enlarged tip.

18. The plug of claim 17 wherein said pin stalk is sized and configured to slidingly seat within the bore extending into the collar.

19. The plug of claim 18 wherein said enlarged tip has an outer diameter greater than an inner diameter of the rib of the bore.

20. The plug of claim 19 wherein the enlarged tip is of minimal vertical extent relative to a distance between the rib of the bore and a base of the bore.

21. The plug of claim 20 wherein said enlarged tip of said pin engages beneath the rib of the bore in a snap fit manner and is held within the bore thereby.

* * * * *